United States Patent [19]

Escher et al.

[11] 4,302,353

[45] Nov. 24, 1981

[54] METHOD FOR THE PRODUCTION OF SYNTHESIS GAS

[75] Inventors: Gerd Escher, Gelsenkirchen-Buer; Johann Harjung, Dorsten; H. Peter Wenning, Gelsenkirchen-Buer, all of Fed. Rep. of Germany

[73] Assignee: Veba Oel AG, Gelsenkirchen-Buer, Fed. Rep. of Germany

[21] Appl. No.: 79,582

[22] Filed: Sep. 27, 1979

Related U.S. Application Data

[63] Continuation of Ser. No. 904,372, May 10, 1978, abandoned.

[30] Foreign Application Priority Data

May 11, 1977 [DE] Fed. Rep. of Germany ..... 2721047

[51] Int. Cl.[3] ..... C10J 3/46

[52] U.S. Cl. ..... 252/373; 48/86 R; 48/197 R; 48/206; 241/1

[58] Field of Search ..... 48/210, 86 R, 206, 202, 48/DIG. 4, 197 R, 63; 252/373; 44/10 R, 10 E; 201/6, 38; 241/1, 23; 110/110

[56] References Cited

U.S. PATENT DOCUMENTS

| | | | |
|---|---|---|---|
| 2,647,045 | 7/1953 | Rummel | 48/206 |
| 2,662,007 | 12/1953 | Dickinson | 48/DIG. 4 |
| 3,010,882 | 11/1961 | Barclay et al. | 201/6 |
| 3,036,906 | 5/1962 | Zellerhoff et al. | 48/63 |
| 3,674,449 | 7/1972 | Schmalfeld et al. | 44/10 R |
| 3,920,418 | 11/1975 | Rice | 48/206 |
| 4,057,400 | 11/1977 | Kaimann et al. | 48/86 R |

FOREIGN PATENT DOCUMENTS

| | | | |
|---|---|---|---|
| 2629182 | 12/1977 | Fed. Rep. of Germany | 48/210 |
| 1435089 | 5/1976 | United Kingdom | 48/202 |

*Primary Examiner*—Peter F. Kratz

*Attorney, Agent, or Firm*—Oblon, Fisher, Spivak, McClelland & Maier

[57] ABSTRACT

A method for the continuous production of synthesis gas comprising carbon monoxide and hydrogen through the autothermal gasification of solid combustibles in a pressure reactor which comprises:

introducing into a screw machine containing two parallely ordered shafts, a finely divided solid combustible, moistening and intimately mixing the solid combustible with 2 to 30% by weight of water, degasing and compressing the moist solid combustible to a pressure higher than that of the reactor, adding the gas-tight compressed and moist solid combustible to a reaction chamber-through a burner where the combustible is brought into contact with the gasification medium, thereby evaporating the water in the compressed and moist solid combustible and producing a comminuted dispersion of the solid combustible in the mixture of the gasification medium and water vapor;

reacting the combustible dispersion to give a raw synthesis gas and removing the raw synthesis gas from the reactor.

9 Claims, 2 Drawing Figures

METHOD FOR THE PRODUCTION OF SYNTHESIS GAS

This is a continuation of application Ser. No. 904,372, filed May 10, 1978, now abandoned.

BACKGROUND OF THE INVENTION

1. Field of the Invention

The present invention relates to a method for the production of synthesis gas from the autothermal gasification of coal dust, water and oxygen.

2. Description of the Prior Art

Methods for the production of synthesis gases are known wherein the solid combustibles are introduced into the reaction chamber with a pump as a coal/water-suspension. These methods have the disadvantage in that the excess added water has to be evaporated. This brings about an unnecessary heat load and leads to a increased formation of carbon dioxide and therefore to a strong increase in the oxygen and also the combustible utilization. Such a method is described in DT-AS 20 44 310.

Another method is also known wherein the combustible sludge is heated in the gasification reactor under pressure to such an extent that a possibly complete evaporation of the water is reached. The so obtained dispersion is then transfered to a gasification installation. A drawback of this well known method is the difficult heating of the coal/water-suspension to its evaporation temperature, wherein the heating elements are put out by erosion due to the solid combustible particles.

There are also known methods for the conversion of solid combustibles in a high pressure chamber, wherein the finely ground combustible is compressed while in the addition line to the chamber, to a gas tight cram by means of a pressure piston or a screw press. During the gasification of finely divided solid combustibles, the problem arises in introducing into the gasification reactor, a sufficiently homogeneous dispersion of combustible/oxygen/steam; wherein, in the well known methods, the gasified combustible stopper is brought, before introduction into the pressure reactor, into its original finely divided state by means of a frictional apparatus. This frictional apparatus is subject, by the addition of solid combustibles, to an increased wear.

SUMMARY OF THE INVENTION

The task then consisted in the determination of a method wherein the introduction of a solid combustible into a gasification reactor held under increased pressure would allow said introduction without a screw press furnishing a frictional apparatus.

This task was solved by addition of water, even in relatively small amounts to the coal fines in the screw machine, wherein it was found surprisingly that even by the addition of small amounts of water, during introduction of the compressed combustible into the hot reactor, a comminution of said combustible takes place. A support for the comminution follows through the gasification medium, so that the latter can then be directly led onto the compressed combustible, so that a comminuting affect will take place simultaneously.

DESCRIPTION OF THE PREFERRED EMBODIMENTS

The object of the invention is therefore to give a method for the continuous production of synthesis gas on the basis of carbon monoxide and hydrogen through the autothermal gasification of solid combustibles, preferably coal dust, water and oxygen in a reactor, at a temperature in the range of from 800° to 1700° C. and a pressure of 10 to 150 bar, wherein the finely divided solid combustible, particularly coal dust is introduced into a screw machine which contains two parallel shafts, then moistened with 2–30% by weight of water, intimately mixed, degased and compressed to a pressure higher than that existing in the reactor, and then the gas tight, moist combustible cram, particularly carbon dust cram is passed over a burner while introduced into the hot reaction chamber, brought to reaction with gasification medium and the resulting raw synthesis gas is withdrawn from the reaction.

Thus obtained raw synthesis gas is then worked up in a well known fashion. The ash which has fallen into the reactor is withdrawn from the pit. The screw press can be established laterally or perpendicularly onto the reactor. The gasification medium added to the burner can be oxygen, a gas containing molecular oxygen and if necessary it can also contain water vapor. The mass which is again decomposed into fine particles, then enters the gasification reactor, followed by the transformation of the components.

Figure 1:
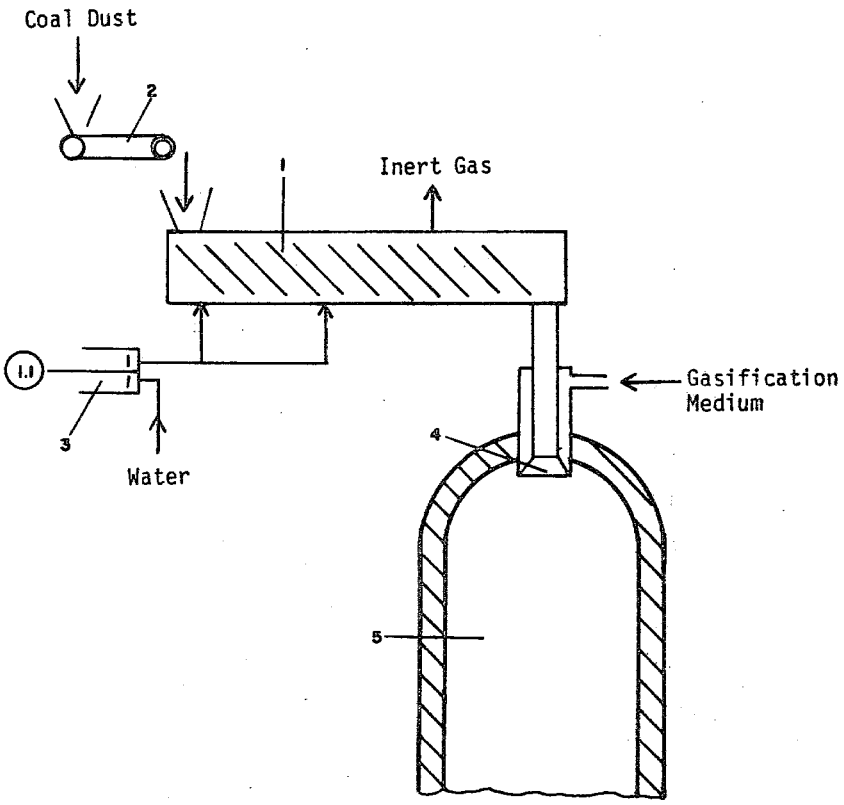
FIG. 1 shows a schematic model of the invention for the introduction and comminution of the combustible, with a lateral arrangement of the screw press.
Figure 2:
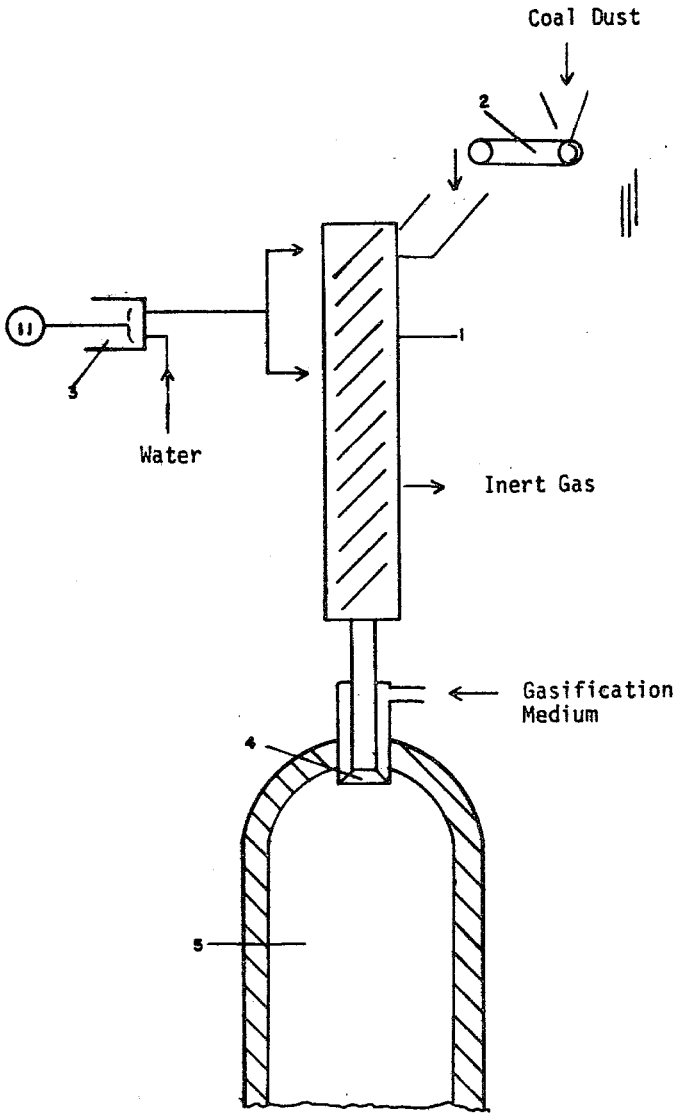
FIG. 2 shows a schematic model with a perpendicular arrangement of the screw press.

The screw press 1, depicted in FIG. 1, is supplied of solid combustible through the dosage outfit 2 and of water and if necessary of other liquid additives through dosage outfit 3. After a mixing zone, the gas entrapped by addition of the combustible is eliminated. Therein follows the compression of the moist combustible to a gas dense cram. At the burner 4, this solid material cram is brought into contact with the gasification medium. The water in the combustible evaporates suddenly upon entrance of the combustible into the hot reactor 5. As a consequence, there is produced a complete communition of the densified coal dust so that a homogeneous coal dust/oxygen/vapor dispersion is produced.

In order to carry out the methodology of the present invention it is possible to use as solid combustibles, lignite, mineral coal, coal coke and petroleum coke.

Liquid additives are liquid combustibles and lubricants such as oils, sulfite liquors or molasses. These can be added in amounts of up to 40% by weight.

The method of the above mentioned invention will be illustrated by the following examples without being limitative thereof:

EXAMPLES

Mineral Coal, which has been moistened with water, is introduced by means of the described screw installation into a filler-free masonry pressure reactor and gasified under addition of oxygen or oxygen/vapor.

| Analysis of the Combustible. | |
|---|---|
| Carbon | 67.3 by weight |
| Hydrogen | 4.3% by weight |
| Oxygen | 6.6% by weight |
| Nitrogen | 1.13% by weight |
| Sulfur | 1.37% by weight |
| Water | 2.60% by weight |
| Ash | 16.7% by weight |
| Heat Value $HU_{WAF}$ | 36.6 MJ/kg (7790 kcal/kg) |

| Conditions of the Method and Results of the Gasification | | | |
|---|---|---|---|
| Gasification Pressure | Bar | 60 | |
| Gasification Temperature | °C. | 1500 | |
| Reactor Entrance Temperature | °C. | | |
| Carbon | °C. | 220 | |
| Oxygen | °C. | 140 | |
| Steam | °C. | 400 | |
| | | EXAMPLE | |
| | | 1 | 2 |
| Introduction into the reactor | | | |
| Mineral Coal | kg/h | 615 | 606 |
| Water | kg/h | 203 | 49 |
| Steam | kg/h | — | 131 |
| Exit from the Reactor | | | |
| Raw Gas Stream, dry | $Nm^3/h$ | 1113 | 1091 |
| Raw Gas Analysis: $H_2$ | Vol. % | 31.4 | 32.4 |
| CO | Vol. % | 58.5 | 59.2 |
| $CO_2$ | Vol. % | 8.8 | 7.1 |
| $CH_4$ | Vol. % | 0.1 | 0.1 |
| $H_2S$ | Vol. % | 0.5 | 0.5 |
| $N_2$ | Vol. % | 0.7 | 0.7 |
| Unburned Carbon | % by weight | 3.0 | 3.0 |

What is claimed as new and intended to be secured by Letters Patent of the United States is:

1. A method for the continuous production of synthesis gas comprising carbon monoxide and hydrogen by autothermally gasifying solid combustibles in the presence of a gasification medium, in a pressure reactor at a temperature in the range of 800°-1700° C. and a pressure of from 10-150 bar, which comprises:

introducing into a screw machine which contains two parallely ordered shafts a finely divided solid combustible;

moistening and intimately mixing said solid combustible with 2 to 30% by weight of water;

degasing and compressing said moist solid combustible to a pressure higher than that of the reactor;

adding the gas-tight, compressed and moist solid combustible to a reaction chamber through a burner, where said combustible is brought into contact with a gasification medium; thereby evaporating the water in said compressed and moist solid combustible and producing a comminuted dispersion of said solid combustible in a mixture of said gasification medium and said water vapor;

reacting said combustible dispersion to give a raw synthesis gas and removing said raw synthesis gas from said reactor.

2. A method according to claim 1, wherein said gasification medium comprises oxygen, or a molecular oxygen containing gas and may optionally contain additional water vapor.

3. A method according to claims 1 or 2 wherein the screw machine is arranged laterally to the pressure reactor.

4. A method according to claims 1 or 2 wherein the screw machine is arranged perpendicularly to the pressure reactor.

5. A method according to any of claims 1 or 2, wherein liquid combustibles are added to said solid combustibles.

6. A method according to any of claims 1 or 2, wherein lubricants are added to said solid combustibles.

7. A method according to any of claims 1 or 2, wherein the gasification medium is added directly to the hot compressed solid combustible upon entrance of said combustible into the burner.

8. The method of claim 1, where said solid combustible is coal dust.

9. The method of claim 1, wherein said solid combustible is selected from the group consisting of lignite, mineral coal, and coal coke.

* * * * *